US010808189B2

(12) United States Patent
Calla et al.

(10) Patent No.: US 10,808,189 B2
(45) Date of Patent: Oct. 20, 2020

(54) PROCESS FOR PRODUCTION OF BASE STOCKS

(71) Applicant: ExxonMobil Research and Engineering Company, Annandale, NJ (US)

(72) Inventors: Jason T. Calla, Raritan, NJ (US); Gary P. Schleicher, Milford, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/386,764

(22) Filed: Apr. 17, 2019

(65) Prior Publication Data

US 2019/0338204 A1 Nov. 7, 2019

Related U.S. Application Data

(60) Provisional application No. 62/667,806, filed on May 7, 2018.

(51) Int. Cl.
*C10G 69/10* (2006.01)
*C10G 47/00* (2006.01)
(Continued)

(52) U.S. Cl.
CPC ..... *C10G 69/10* (2013.01); *C10G 47/00* (2013.01); *C10M 101/02* (2013.01);
(Continued)

(58) Field of Classification Search
CPC ..... C10G 47/00; C10G 49/00; C10G 65/12; C10G 69/10; C10G 2300/202;
(Continued)

(56) References Cited

U.S. PATENT DOCUMENTS 3,509,039 A * 4/1970 Helion ..... C10G 73/36 208/31
5,358,628 A * 10/1994 Apelian ..... B01J 29/7415 208/60
(Continued)

OTHER PUBLICATIONS

Mózes, G. (1982). Paraffin Products: Properties, Technologies, Applications. Burlington: Elsevier, 13-140 [Office action cites p. 52].*
(Continued)

*Primary Examiner* — Brian A McCaig
(74) *Attorney, Agent, or Firm* — Scott F. Yarnell

(57) ABSTRACT

Base stocks having Group III/III+ characteristics are prepared from certain advantageous crude oils via simplified process configurations and/or under less severe process conditions. Crude oils comprising a vacuum gas oil (VGO) fraction having a ratio of a sum of paraffin content plus 1-Ring species content to multi-ring species content that is greater than or equal to about 1.5 are advantageous in this context. Other parameters such as API gravity and crude compositional ranges may also be considered for identifying advantageous crudes. In some instances, advantageous crudes are processed into Group III base stocks via a process configuration in which the crude oil is directly supplied to a hydroprocessing unit.

31 Claims, 5 Drawing Sheets

(51) Int. Cl.
*C10M 101/02* (2006.01)
*C10N 20/02* (2006.01)

(52) U.S. Cl.
CPC ..... *C10G 2300/1074* (2013.01); *C10G 2300/1077* (2013.01); *C10G 2300/1081* (2013.01); *C10G 2300/1096* (2013.01); *C10G 2300/202* (2013.01); *C10G 2300/302* (2013.01); *C10G 2400/10* (2013.01); *C10M 2203/1065* (2013.01); *C10N 2020/02* (2013.01)

(58) Field of Classification Search
CPC .... C10G 2300/1074; C10G 2300/1077; C10G 2300/1081; C10G 2300/1096; C10M 101/02; C10N 2220/022
See application file for complete search history.

(56) References Cited

U.S. PATENT DOCUMENTS 6,156,695 A 12/2000 Soled et al.
6,162,350 A 12/2000 Soled et al.
6,299,760 B1 10/2001 Soled et al.
6,582,590 B1 6/2003 Riley et al.
6,712,955 B1 3/2004 Hou et al.
6,783,663 B1 8/2004 Riley et al.
6,863,803 B1 3/2005 Riley et al.
6,929,738 B1 8/2005 Riley et al.
7,229,548 B2 6/2007 Riley et al.
7,288,182 B1 10/2007 Soled et al.
7,410,924 B2 8/2008 Corma Canos et al.
7,544,632 B2 6/2009 Soled et al.
8,394,255 B2 3/2013 McCarthy et al.
2002/0189972 A1 12/2002 Benazzi et al.
2005/0165267 A1 7/2005 Canos et al.
2005/0277545 A1 12/2005 Shih et al.
2006/0060502 A1 3/2006 Soled et al.
2007/0084754 A1 4/2007 Soled et al.
2008/0132407 A1 6/2008 Bai et al.
2008/0146438 A1* 6/2008 Bai ..... C10G 45/08 502/173
2009/0261015 A1* 10/2009 Joseck ..... C10M 177/00 208/27
2009/0321320 A1 12/2009 Wu et al.
2010/0012554 A1 1/2010 Bai et al.
2010/0133148 A1 6/2010 Timmler et al.
2010/0320123 A1 12/2010 Wu et al.
2013/0179092 A1 7/2013 Martin et al.
2015/0027925 A1 1/2015 Joseck et al.
2018/0105761 A1 4/2018 Calla et al.

OTHER PUBLICATIONS

The International Search Report and Written Opinion of PCT/US2019/027875 dated Jun. 26, 2019.

* cited by examiner

PROCESS FOR PRODUCTION OF BASE STOCKS

CROSS-REFERENCE TO RELATED APPLICATIONS

This application claims the benefit of U.S. Provisional Application No. 62/667,806, filed on May 7, 2018, the entire contents of which are incorporated herein by reference.

FIELD

This disclosure relates to production of base stocks from crude oil. This disclosure further relates to the production of high viscosity index (VI) base stocks, such as Group III and III+ base stocks.

BACKGROUND

Base stock is a major constituent in finished lubricants and the characteristics of the base stock contribute significantly to the properties of the finished lubricants. Finished lubricants include engine oils, crankcase lubricants, and various industrial lubricants. In general, finished lubricants comprise at least one base stock along with various additives for altering and/or improving characteristics of the lubricant. In some instances, a blend of base stocks, referred to as a base oil, may be utilized in the finished lubricants.

Base stocks are categorized according to the American Petroleum Institute (API) classifications based on saturated hydrocarbon content, sulfur level, and viscosity index (see Table 1 infra). Typically, Group I, II, and III base stocks are each derived from crude oil via extensive processing, such as fractionating, solvent extraction, solvent dewaxing, and hydroisomerization. Group III base stocks can also be produced from synthetic hydrocarbon liquids obtained from natural gas, coal, or other fossil resources. Group IV base stocks are polyalphaolefins (PAOs), and are produced by the oligomerization of alpha olefins. Group V base stocks include all base stocks that do not belong to Groups I-IV, such as naphthenics, polyalkylene glycols (PAG), and esters.

Additionally, there are the informal categories of base stocks referred to as "Group II+" and "Group III+" that are generally recognized within the lubricant industry as corresponding to base stocks that exceed the minimum classification requirements of the formal group. For example, a "Group II+" base stock may have a viscosity index (VI) above 110 and a "Group III+" base stock may have a viscosity index (VI) between 130 and 150.

TABLE 1

| | API Classification | | | | |
|---|---|---|---|---|---|
| Property | Group I | Group II | Group III | Group IV | Group V |
| % Saturates | <90 | ≥90 | ≥90 | Polyalpha-olefins (PAOs) | All others not belonging to group I-IV |
| % Sulfur | >0.03 | ≤0.03 | ≤0.03 | | |
| Viscosity Index (VI) | 80-120 | 80-120 | ≥120 | | |

Some base stocks are produced byhydroprocessing the higher boiling fractions recovered from a vacuum distillation operation on crude feeds. In this context, hydroprocessing refers to catalytic hydrotreatment and/or hydrocracking. Base stocks may also be prepared from either petroleum-derived or syncrude-derived feed stocks or via synthesis from lower molecular weight molecules. Some current manufacturers of Group III/III+ base stocks utilize gas-to-liquid (GTL) processes, such as the Fischer Tropsch process. The GTL processes require, in general, more expensive processing equipment than alternative routes. Other current manufacturers of Group III/III+ base stocks utilize high (e.g., greater than about 40 wt. %) wax content crude oils ("waxy crudes"). However, the availability of waxy crudes is limited within some geographic regions. Also, waxy crudes are often relatively expensive as compared to other crude types. Other routes available for the production of high performance base stocks include isomerization of petroleum wax obtained from solvent dewaxing in the production of lower grade base stocks (e.g., Group I base stock).

In general, the characteristics of crude oils are different according to geographic origin. The particular mix of hydrocarbon molecules and other components in the crude will vary according to the oil-producing basin or formation from which the crude has been extracted. Various physical characteristics of crude oils are used as factors in determining its economic value and/or ultimate use. For example, specific gravity (density) for a crude oil is often reported as API (American Petroleum Institute) gravity as determined according to an industrial standard, such as ASTM D4052-16. Additionally, detailed compositional analysis of crude oils can be made according to known methods, such that sulfur content, paraffin content, aromatic content, naphthene content, and multi-ring content, amongst other characteristics, can be determined for each crude type. However, these measured and reported physical characteristics are not always easily correlated in a known manner to the potential end uses of a crude oil type. For example, which particular crude oil characteristics and compositions correlate to suitability for the production of high VI base stocks has been poorly understood.

SUMMARY

This disclosure relates to production of base stocks from various crude oil types. More specifically, the disclosure relates to production of Group III/III+ base stocks from certain advantageous crude oil types.

In an embodiment, the present disclosure provides a method of producing a base stock, comprising: hydroprocessing a crude oil that comprises a vacuum gas oil (VGO) fraction that has a ratio of (a sum of paraffin content in wt. %+1-ring species content in wt. %) to (multi-ring species content in wt. %) greater than or equal to 1.5 to produce a base stock having a viscosity index greater than 120, as determined according to ASTM D2270-10. In some embodiments, the ratio of (the sum of paraffin content in wt. %+1-ring containing species content in wt. %) to (multi-ring species content in wt. %) is greater than 2.0, or more particularly, greater than 2.5.

In another embodiment, the present disclosure provides a method of producing a base stock, the method comprising: hydroprocessing a crude oil that comprises a vacuum gas oil (VGO) fraction that has a ratio of (a sum of paraffin content in wt. %+1-ring species content in wt. %) to (multi-ring species content in wt. %) greater than or equal to 1.5 to produce a hydroprocessed effluent; fractionating the hydroprocessed effluent to produce an upper fractionate, a lower fractionate, and a middle fractionate; dewaxing the middle fractionate to produce a dewaxed effluent; hydrofinishing the dewaxed effluent to produce a hydrofinished effluent; and fractionating the hydrofinished effluent to produce an overhead fractionate and a residual fractionate. The residual fractionate is a base stock having a viscosity index greater than 120 as determined according to ASTM D2270-10. In some embodiments, the ratio of (the sum of paraffin content in wt. %+1-ring species content in wt. %) to (multi-ring species content in wt. %)) is greater than 2.0, or more particularly, greater than 2.5.

In another embodiment, the present disclosure provides a method of producing a base stock, comprising: feeding a crude oil comprising a VGO fraction that has a ratio of (a sum paraffin content in wt. %+1-ring species content in wt. %) to (multi-ring species content in wt. %) greater than or equal to 1.5 to a hydroprocessing unit to produce a hydroprocessed effluent; fractionating the hydroprocessed effluent in a first fractionating unit to produce an upper fractionate and a lower fractionate; feeding the lower fractionate to a dewaxing unit to produce a dewaxed effluent; feeding the dewaxed effluent to a hydrofinishing unit to produce a hydrofinished effluent; and fractionating the hydrofinished effluent in a second fractionating unit to produce an overhead fractionate and a residual fractionate. The residual fractionate is a base stock oil having a viscosity index (VI) greater than 120, as determined according to ASTM D2270-10. In some embodiments, the ratio of (the sum of paraffin content+1-ring species content in wt. %) to (multi-ring species content in wt. %) is greater than 2.0, or more particularly, greater than 2.5.

In another embodiment, the present disclosure provides a method of producing a base stock, comprising: fractionating a crude oil comprising a vacuum gas oil (VGO) fraction that has a ratio of (a sum of paraffin content in wt. %+1-ring species content in wt. %) to (multi-ring species content in wt. %) greater than or equal to 1.5 to produce a vacuum gas oil (VGO); hydroprocessing the VGO to produce a hydroprocessed effluent; fractionating the hydroprocessed effluent to produce an upper fractionate, a lower fractionate, and a middle fractionate; dewaxing the middle fractionate to produce a dewaxed effluent; hydrofinishing the dewaxed effluent to produce a hydrofinished effluent; and fractionating the hydrofinished effluent to produce an overhead fractionate and a residual fractionate. The residual fractionate is a base stock having a viscosity index greater than 120 as determined according to ASTM D2270-10. In some embodiments, the ratio of (the sum of paraffin content+1-ring species content in wt. %) to (multi-ring species content in wt. %) is greater than 2.0, or more particularly, greater than 2.5.

Other objects and advantages of the present disclosure will become apparent from the detailed description that follows.

DETAILED DESCRIPTION

Figure 1:
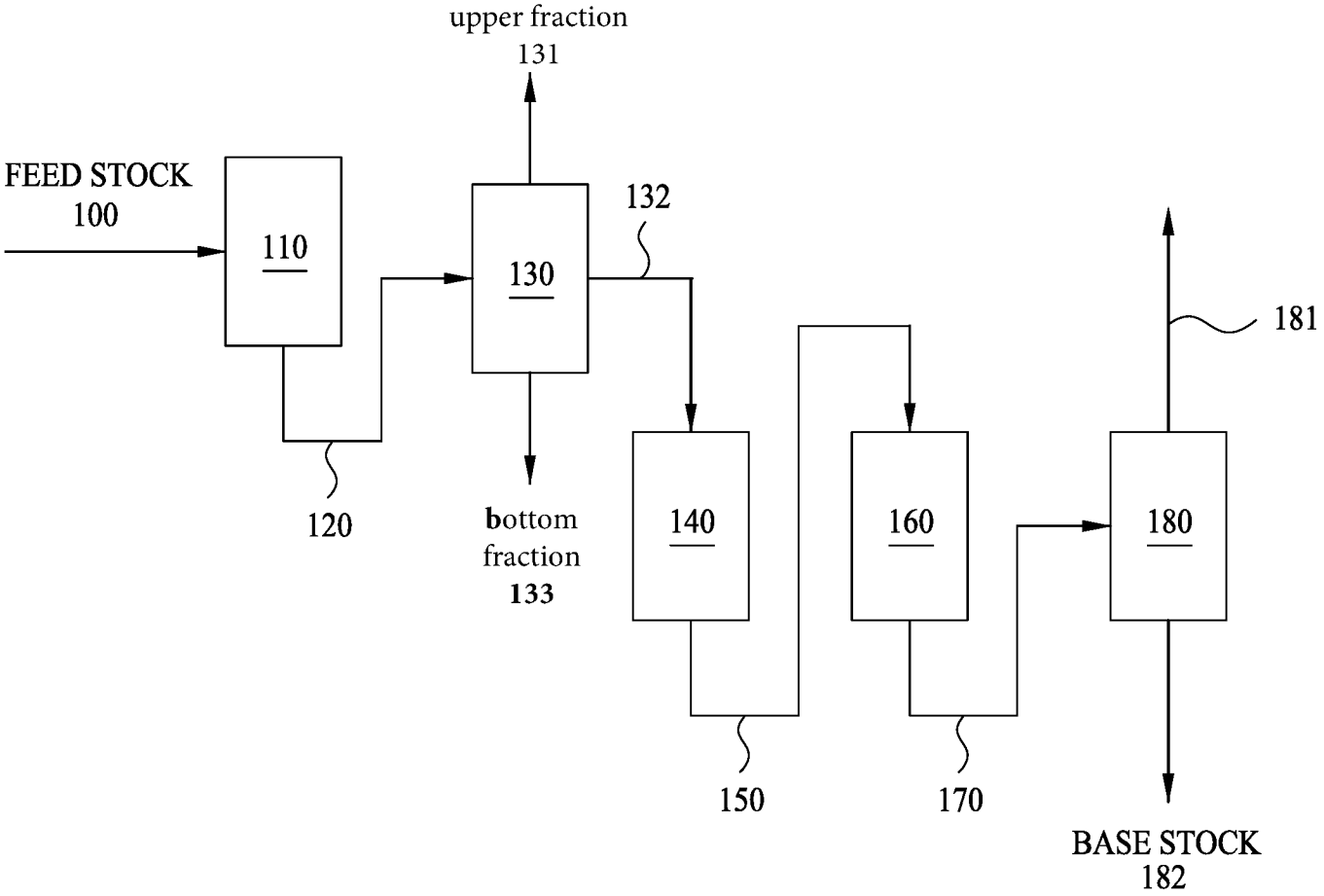
FIG. 1 depicts a production process of a base stock according to an embodiment of the present disclosure.

All numerical values within the detailed description and the claims herein are modified by "about" or "approximately" the indicated value, and take into account experimental error and variations that would be expected by a person of ordinary skill in the art.

As used herein, the term "base stock" means a hydrocarbon liquid useable as a major component of a lubricating oil. As used herein, the term "base oil" refers to a blend of base stocks useable as a major component of a lubricating oil. A used herein, the term "major component" means a component present in a lubricating oil in an amount greater than about 50 weight percent (wt. %). As used herein, the term "minor component" means a component (e.g., one or more lubricating oil additives) present in a lubricating oil in an amount less than about 50 wt. %.

As used herein, a "Group III" base stock is any base stock meeting the API classification standards listed in Table 1. As used herein, a "Group III+" base stock is any base stock meeting the API classification standards listed in Table 1 for Group III base stocks and further having a viscosity index (VI) between 130 and 150, and a % saturated hydrocarbons (saturates) greater than 90% (as compared to merely equal to 90%). Thus, all Group III+ base stocks are also Group III base stocks, but not all Group III base stocks are Group III+ base stocks. As used herein, the term "Group III/III+ base stock" refers to any base stock that is a Group III or Group III+ as those terms are defined above. As used herein, "kinematic viscosity at 100° C." may be used interchangeably with "KV100," and "kinematic viscosity at 40° C." may be used interchangeably with "KV40."

As used herein, the term "1-ring species content" means a saturated or unsaturated hydrocarbon compound including or containing a single, closed ring moiety. As used herein, the term "multi-ring species content" means a saturated or unsaturated hydrocarbon compound including or containing at least two closed ring moieties. When content is expressed in weight percent (wt. %) the stated percentage is with respect to total weight of the relevant sample material.

As used herein, the term "VGO fraction" or "VGO cut" refers to a vacuum gas oil (VGO), which is a distillate fraction of crude oil obtained within a boiling point range of 650° F. (343° C.) to 1050° F. (566° C.) as determined using an appropriate ASTM test method, such as the procedures described in ASTM D6352. As used herein, the term "700 F+ conversion (wt. %)" refers to mass ratio of material in a feed that boils above 700° F. (371° C.) prior to any hydroprocessing to material that boils above 700° F. (371° C.) after the hydroprocessing. In general, this is a measure of hydroprocessing severity in which a higher 700 F+ conversion (wt. %) correlates to higher hydroprocessing severity.

Feedstocks

The present inventors have surprisingly discovered a novel method for producing high yields of high quality, high VI base stocks and base stock precursors such as feedstocks and intermediates. The method utilizes certain techniques to identify particular characteristics and/or compositions of a crude oil that indicate suitability for producing the high yields of high quality, high VI base stocks. According to the present disclosure, a wide range of crude oils may be used either directly as feedstocks or to derive feedstocks via pre-processing or the like. Suitable feedstocks in various embodiments of the present disclosure include whole and "topped" petroleum crudes.

In general, the yield of high VI base stocks manufactured via hydroprocessing of vacuum gas oils (VGOs) is highly dependent on the molecular composition of the VGO. However, it has been surprisingly determined that certain crudes types are particularly well-suited for the production of Group III/III+ base stocks via hydroprocessing. These particular crude types are referred to herein as collectively as "advantageous crudes."

According to an embodiment of the present invention, a method of identifying advantageous crudes uses values from API gravity measurements on candidate crudes. For example, crudes with a higher API gravity may have a higher concentration of paraffin and lower concentration of multi-ring containing species than crudes from the same formation but having a lower API gravity. By way of theory without intending to be limited thereto, the maturation process of crudes from lower to higher API gravity naturally leads to a change in composition (i.e., increased paraffin content; lower multi-ring containing species content) and leads to less variation in molecular composition between crudes from different formations. In addition, crudes of higher API gravity tend to have lower sulfur content and can thus be hydroprocessed under less severe conditions. However, crudes with too high of an API gravity may yield too little VGO to be desirable in the production of base stocks according to the present disclosure. For example, API gravity above about 55 for certain crude sources is not as desirable as an API gravity in the 45 to 55 range. Table 2 provides general properties for the VGO derived from two crude oils extracted from the same formation yet having different API gravities. In Table 2, "SDWO VI" refers to solvent dewaxed oil viscosity index, and "Cut Yield (Vol %)" refers to the volume of the crude cut provided according to the stated boiling ranges.

TABLE 2

| Property | Crude I (~46 API) | Crude II (~49 to ~55 API) |
|---|---|---|
| SDWO VI | 92 | 120 |
| Wax % | 23 | 34 |
| Sulfur | 0.5% | 0.05% |
| Cut Yield (Vol %) 650° F.-1050° F. | 24% | 18% |
| Cut Yield (Vol %) +1050° F. | 8% | 2% |

According to various embodiments, API gravity is used as a screening characteristic for identifying advantageous crudes. The desirable API gravity range may differ according to the formation from which the crude is extracted. For example, Crude I having API gravity in the 45 to 55 range is an advantageous crude, while Crude II having API gravity in the 49-55 range is an advantageous crude. However, for other crudes extracted from different formations, an API gravity as low as 25 is an advantageous crude. Based on the guidance provided herein, a person of ordinary skill in the art could readily determine a specific desired range of API for crude oils from a particular formation. According to an embodiment of the invention, an advantageous crude oil has an API of 25-55. According to another embodiment, an advantageous crude oil has an API of 35-55. According to another embodiment, an advantageous crude oil has an API of 45 to 55. According to another embodiment, an advantageous crude oil has an API of 49 to 55. According to another embodiment, an advantageous crude oil has an API of 49-53.

Further characterization of crude types is used for screening for advantageous crudes, according to various embodiments of the present disclosure. For example, compositional analysis for different molecular species, such as paraffin, naphthenes, and aromatics, are used to identify advantageous crudes, according to an embodiment of the present disclosure. For example, certain crudes having paraffin content in a range of 25-76 wt. %, a naphthenes content in a range of 21-52 wt. %, and an aromatics content of 3-38 wt. % are advantageous in accordance with an embodiment. More particularly, in certain instances, crudes having paraffin content in a range of 34-53 wt. %, a naphthenes content in a range of 33-51 wt. %, and an aromatics content of 8-20 wt. % are advantageous in certain instances.

Compositional characterization is further refined by evaluation of compositional ratios within particular crudes, according to various embodiments of the present disclosure. For example, a compositional ratio of (a sum of amount of paraffin content in wt. %+1-ring species content in wt. %) to (multi-ring species content in wt. %) is determined for a VGO fraction from a candidate crude to identify an advantageous crude in accordance with an embodiment. According to an embodiment, a crude oil has a VGO fraction with a compositional ratio that is at least about 1.5. According to another embodiment, the foregoing compositional ratio is at least 1.9. According to another embodiment, the foregoing compositional ratio is at least 2.0. According to another embodiment, the foregoing compositional ratio is at least 2.5. According to another embodiment, the foregoing compositional ratio is at least 3.

Additionally, the API gravity, the specific composition, and the compositional ratios may be collectively evaluated to identify advantageous crudes. For example, according to an embodiment of the invention, a crude oil has a vacuum gas oil cut having a compositional ratio of (a sum of paraffin content in wt. %+1-ring species content in wt. %) to (multi-ring species content in wt. %) that is at least 1.5 and an API gravity of at least 45.

Aromatic content can be measured by various methods including chromatography and ultraviolet spectroscopy, such as those described in U.S. Pat. Pub. No. 2013/0179092 A1, published Jul. 11, 2013, which is incorporated herein by reference. Additionally, techniques such as mass spectroscopy and NMR spectroscopy can be used to establish detailed composition of a crude oil. The empirical n-d-M method is also available for determining carbon type (paraffinic carbon, naphthenic carbon, and aromatic carbon) distributions in a sample oil by relatively simple measurements of physical parameters, such as refractive index (n), density (d) and molecular weight (M).

Production of Base Stocks

In accordance with this disclosure, crude oils having particular characteristics have been surprisingly discovered by the present inventors to provide unexpectedly high yields of Group II/III+ base stock. Additionally, crude oils having these particular characteristics can be processed to provide Group III/III+ base stock via simplified production process flows according to the present disclosure. The simplified process flows provide a possible reduction in production costs for base stocks. Furthermore, certain crude oils processible via the disclosed simplified process flows may be available at lower cost, in some instances, within particular geographic regions than crude oils presently considered desirable for Group III/III+ base stock production.

According to an embodiment, the Group III base stocks produced according to the present disclosure have less than 0.03 wt. % sulfur, a pour point of −10° C. to −30° C., a Noack volatility of 0.5 wt. % to 20 wt. % a CCS (cold crank simulator) value at −35° C. of 100 cP up to 70,000 cP, and naphthene content of 30-70 wt. %. Group III base stocks produced according to the present disclosure can be light neutral, medium neutral, or heavy neutral bask stocks and have a KV100 in a range of 2 cSt to 15 cSt.

The processing flows of the present disclosure intake a feedstock and provide a base stock as at least one product. Additional products, such as fuel-type components (for example, without limitation, gasoline, naphtha, and diesel) and/or heavier residual components (for example, without limitation, vacuum gas oil and vacuum bottoms), may also be provided from the feedstock. Likewise, various by-products and/or contaminants and/or waste products may be removed and/or generated from the feedstock in these processing flows. In general, such by-products, contaminants, and/or waste products may be handled according to conventional processing methods and detailed description of such aspects may be omitted from the description of example processing flows and configurations provided in this disclosure. Additionally, unless otherwise mentioned, the operating conditions and/or particular designs for individual processing units described in the present disclosure may be considered to be standard operating conditions and designs either known to those of ordinary skill in the art or selectable by those of ordinary skill in the art according to context and other known or stated parameters.

Feedstock Processing

The process examples described below are used to produce base stocks, such as Group III or Group III+ base stocks, from an advantageous crude.

Generally, according to an embodiment, a method of producing a base stock comprises hydroprocessing a crude oil feed that has VGO cut with a desirable compositional ratio as identified herein. For example, a crude oil feed comprising a VGO cut having a ratio of (the sum of paraffin content in wt. %+1-ring-species content in wt. %) to (multi-ring-species content in wt. %) that is greater than about 1.5 may be referred to in the following as a "surprisingly advantageous crude" or more simply as an "advantageous crude."

In this context, the "crude oil feed" is a crude or blend of crudes that has not been substantially processed post-extraction. That is, other than any processing or alteration attendant to transportation from extraction site, the crude oil or crude oils of the crude oil feed are substantially unchanged from the extracted state. In this context, substantial processing post-extraction excludes minor refining processes, such as atmospheric fractionation, that do not significantly alter the relevant characteristics of the crude. For example, the crude oil feed according to the disclosure may be a "topped" crude, which is a crude that has been subjected only to atmospheric fractionation or the like for the removal of the highly volatile components. In some embodiments, the crude oil feed may be fractionated to produce a vacuum gas oil (VGO), which corresponds to a distillate cut of the crude oil feed between 650° F. and 1050° F.

In some embodiments, the hydroprocessed crude feed is further subjected to a first fractionating process, and a resulting fraction therefrom is then subjected to a further hydroprocessing step or steps, followed by a second fractionating process.

In a conventional process, the crude oil feed is typically vacuum distilled/fractionated to provide a heavy vacuum gas oil, which is subsequently fed to a first stage hydroprocessing unit. The first stage hydroprocessing is followed by a stripping section where lighter, fuel-type components are removed. The remaining heavier lube fraction then enters a second stage processing where hydrocracking, dewaxing, and hydrofinishing are performed. A second stripping process further removes fuel-type components, leaving the base stock product. In general, this conventional process must utilize more intense hydrotreatment processes to achieve similar base stock product properties as those provided by the embodiments of the present disclosure.

Harsher, more intense hydroprocessing steps, such as hydrocracking, generally are more expensive to implement and perform. Thus, the present disclosure provides lower cost and/or more efficient base stock production methods. The process configurations of the present disclosure produce high-quality Group III base stock without the intensive hydroprocessing necessary in some of the conventional schemes. Likewise, the process configurations of the present disclosure may entirely eliminate the need for certain conventional processing steps, such as the fractionation of an incoming crude feed prior to first stage processing and/or any hydrocracking processing. The use of advantageous crudes according to the present disclosure permits use of a simpler process scheme for the production of Group II/III+ base stocks.

Process Configuration Embodiments for Production of Base Stocks

As used herein, a "stage" in a process configuration, process flow, or process scheme can correspond to a single reactor or a plurality of reactors provided in series. Optionally, two or more parallel reactors can be used to perform the processes within a stage. Each stage and/or reactor can include one or more catalyst beds containing hydroprocessing catalyst or dewaxing catalyst. It is noted that a "bed" of catalyst can refer to a partial physical catalyst bed. For example, a catalyst bed within a reactor could be filled partially with a hydrofinishing catalyst and partially with a dewaxing catalyst. For convenience in description, even though the two catalysts may be stacked in a single catalyst bed, the hydrofinishing catalyst and dewaxing catalyst can each, conceptually, be considered as separate catalyst beds or reactors.

Direct Crude Feed Processing Embodiment

FIG. 1 depicts a process configuration for producing a base stock from an advantageous crude according the present disclosure. In this process configuration example, a feedstock 100 is directly fed to a first reactor 110 to produce an effluent 120. The first reactor 110 is a hydroprocessing unit. The feedstock 100 is an advantageous crude that has not been substantially processed post-extraction. That is, other than any processing or alteration attendant to transportation from extraction site, the crude oil in feedstock 100 is substantially unchanged from its extracted state, though, in some embodiments, the feedstock 100 may be a "topped" advantageous crude, which is an advantageous crude that has been subjected only to atmospheric fractionation or the like.

The effluent 120 from the first reactor 110 is provided to fractioning unit 130. The fractioning unit 130 provides at least an upper fractionate 131 and a lower fractionate 132. A bottom or residual fraction 133 may be optionally provided in some embodiments. The upper fractionate 131 comprises lighter, fuel-type components separated from the effluent 120. The lower fractionate 132 comprises heavier, less volatile component in the effluent 120. The lower fractionate 132 is provided to second reactor 140. Additional output streams may be provided from fractioning unit 130. For example, the lower fractionate 132 is not necessarily the lowermost or bottom fraction output from the fractioning unit 130. Additional fractionates may be provided from fractioning unit 130, that is, for example, several output streams can be provided by the fractioning unit 130. In some instances, the upper fractionate 131 may comprise multiple output streams, each of which is more volatile than the lower fractionate 132. Likewise, a bottom or residual fractionate 133 may optionally be output from the fractioning unit 130. And, when provided, the bottom fractionate 133 can comprise multiple output streams, each of which is less volatile than the lower fractionate 132.

In this example, the second reactor 140 is a dewaxing unit or a hydrofinishing unit. An effluent 150 from the second reactor 140 is provided to a third reactor 160, which is a dewaxing unit or a hydrofinishing unit. The second reactor 140 and the third reactor 160 are depicted as separate, distinct units in FIG. 1, but in practice these two reactors can be provided as single, combined unit in which both dewaxing and hydrofinishing occur.

Effluent 170 is provided to a second fractioning unit 180. The second fractioning unit 180 provides an upper fractionate 181 and a lower fractionate 182. The upper fractionate 181 comprises lighter, fuel-type components separated from effluent 170. The lower fractionate 182 comprises a base stock.

Indirect Crude Feed Processing Embodiment

Figure 2:
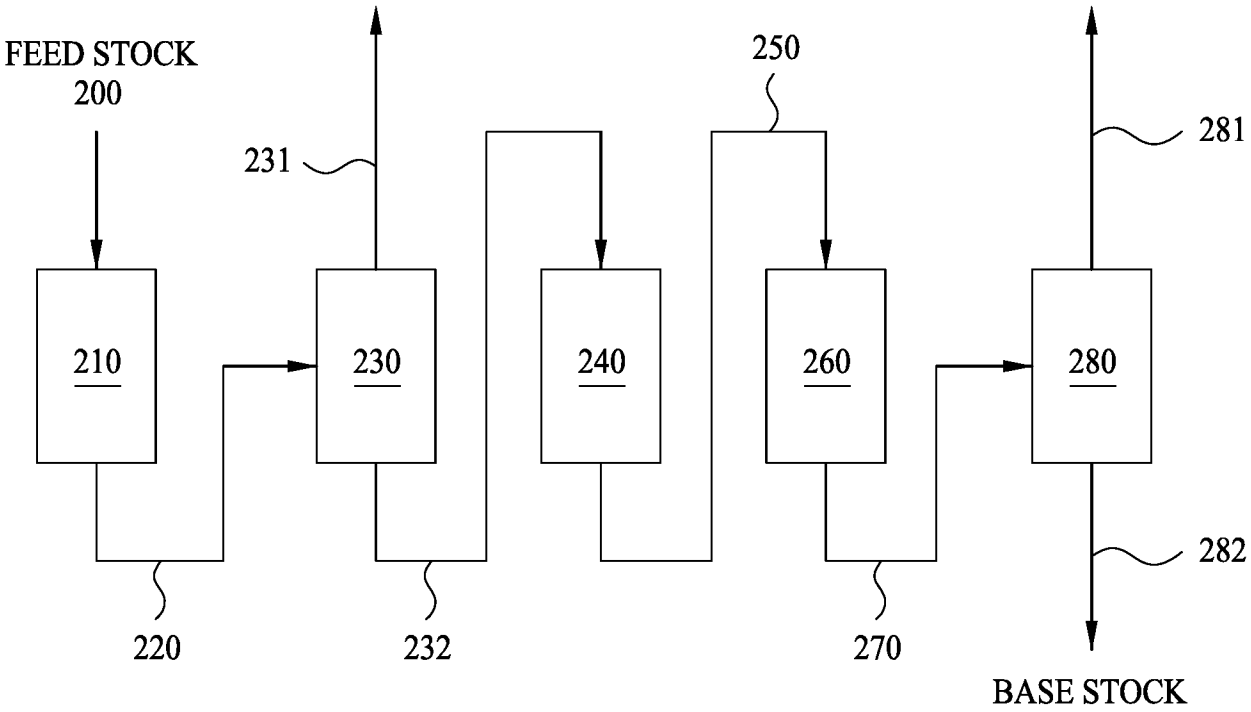
FIG. 2 depicts a production process of a base stock according to another embodiment of the present disclosure.

FIG. 2 depicts a process configuration for production of a base stock according to another embodiment of the present disclosure. In this process configuration, a feedstock 200 is fed to a first reactor 210 to produce an effluent 220. The first reactor 210 is a hydroprocessing unit. In some examples, first reactor 210 includes hydrocracking catalysts or a combination of hydrocracking and hydrotreating catalysts. In this indirect crude feed processing example, the feedstock 200 is not an advantageous crude itself, but rather is derived from an advantageous crude. For example, the feedstock 200 is a topped crude derived from the advantageous crude or a vacuum gas oil derived from the advantageous crude, for example, by distillation.

The effluent 220 from the first reactor 210 is provided to fractioning unit 230 to provide at least an upper fractionate 231 and a lower fractionate 232. The upper fractionate 231 comprises lighter, fuel-type components separated from the effluent 220. The lower fractionate 232 is provided to second reactor 240. The lower fractionate 232 is not necessarily the lowermost or bottom fraction that is output from the fractioning unit 230. Additional fractionates may be provided by fractioning unit 230. For example, the upper fractionate 231 may comprise multiple output streams, each of which is more volatile than the lower fractionate 232. Likewise, a bottom or residual fractionate may optionally be output from the fractioning unit 230. And, when provided, the bottom or residual fractionate may comprise multiple output streams, each of which is less volatile than the lower fractionate 232.

The second reactor 240 is a dewaxing unit or a hydrofinishing unit. An effluent 250 from the second reactor 240 is provided to a third reactor 260, which is a dewaxing unit or a hydrofinishing unit. The second reactor 240 and the third reactor 260 may be separate, distinct units or a combined unit in which both dewaxing and hydrofinishing occur.

Effluent 270 is provided to a second fractioning unit 280. The second fractioning unit 280 provides an upper fractionate 281 and a lower fractionate 282. The upper fractionate 281 comprises lighter, fuel-type components separated from effluent 270. The lower fractionate 282 comprises a base stock.

Illustration of Comparative Configurations

Figure 3:
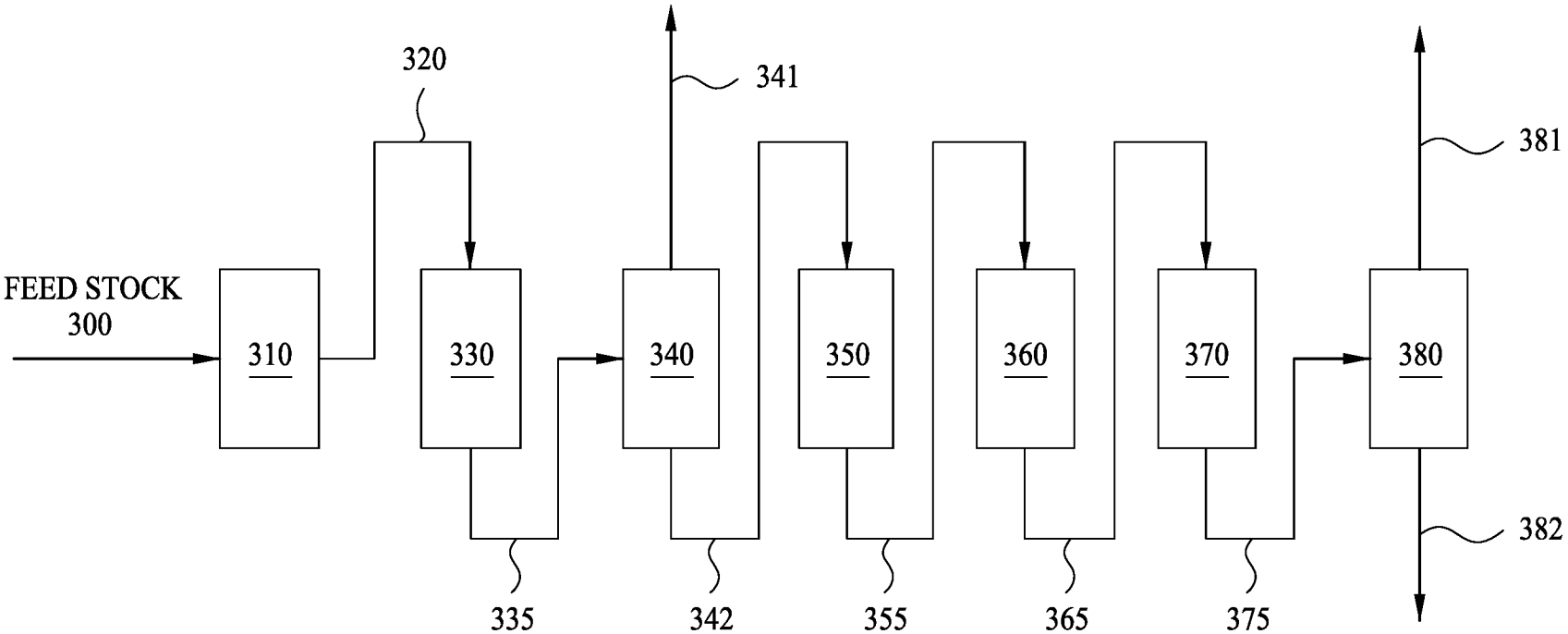
FIG. 3 depicts a production process of a base stock according to a comparative example of the present disclosure.

FIG. 3 shows a comparative example of a process configuration for producing base stocks. In general, FIG. 3 is provided for explaining aspects of certain embodiments of the present disclosure by contrast.

FIG. 3 depicts a feedstock 300, which is a crude oil or derived from a crude oil, fed to a fractioning unit 310. The feedstock 300 is not derived from an advantageous crude.

The fractioning unit 310 is, for example, a distillation column, or the like, which separates the feedstock 300 into various fractions or cuts according to boiling point range. The vacuum gas oil (VGO) fractionate 320 produced from feedstock 300 is provided to a first reactor 330.

The first reactor 330 is a hydroprocessing unit providing a hydrotreating and/or hydrocracking under relatively harsh conditions. Effluent 335 is provided to a fractioning unit 340. The fractioning unit 340 provides an upper fractionate 341 and a lower fractionate 342. The upper fractionate comprises lighter, fuel-type components separated from effluent 335. The lower fractionate 342 is provided to a hydrocracker 350. Effluent 355 from the hydrocracker 350 is provided to a dewaxing unit 360. Effluent 365 from the dewaxing unit 360 is provided to hydrofinishing unit 370. Effluent 375 from the hydrofinishing unit 370 is provided to fractioning unit 380. The fractioning unit 380 provides an upper fractionate 381 comprising lighter, fuel-type components and a lower fractionate 382 comprising a base stock.

The comparative example depicted in FIG. 3 requires the fractionating (in fractioning unit 310) of the feedstock 300 prior to the feeding of any portion of the feedstock 300 to the first reactor 330. In contrast, in the direct feed process depicted in FIG. 1, feedstock 100 is directly fed to the first reactor 110. This comparative example sends only the separated VGO fractionate 320 to the first reactor 330.

Additionally, because the feedstock 300 is not derived from an advantageous crude (such as is the case for feedstock 100 or feedstock 200), harsher processing conditions in the first reactor 330 are typically required than those used in the first reactor 110 or first reactor 210 to achieve similar base stock production levels at similar quality. As noted, the first reactor 330 must provide relatively harsh hydrocracking. Likewise, additional processing units (e.g., hydrocracker 350) are required in the comparative example as compared to the process configurations of FIG. 1 and FIG. 2. Consequently, the simplified process configuration depicted in FIG. 1 and FIG. 2 may be less expensive to establish and operate.

The use of feedstock 200, which is derived from an advantageous crude (in contrast to the feedstock 300, which is not) permits the utilization of the simplified process configuration depicted in FIG. 2. The process configuration of FIG. 2 omits a hydrocracker 350 from the process flow. Furthermore, the use of feedstock 200 instead of feedstock 300 permits less intense processing conditions in first reactor 210 in comparison to those required in first reactor 330.

Furthermore, if the process configuration of FIG. 3 is implemented using an advantageous crude rather than a non-advantageous crude, then less intensive processing conditions in one or more reactor units (330, 350, 360, and/or 370) as compared to when a non-advantageous crude is used, can be utilized. Or alternatively, the yields of the product base stock provided via the process flow of FIG. 3 operating on an advantageous crude may be surprisingly high for otherwise standard processing conditions.

In some optional aspects, the depicted process configurations in FIGS. 1, 2, and 3 may be modified to incorporate one or more recycle loops in which a portion of an effluent or fractionate from a reactor or a fractioning unit is returned for additional processing.

Processing Units

A reactor includes a feed inlet and an effluent outlet. In general, a reactor can be a hydrotreating unit, a hydrocracking unit, hydrofinishing unit, a dewaxing unit or a combination thereof. In some examples, a reactor comprises a plurality of reactor units connected in series and/or parallel. If a configuration includes multiple reactor units in series, a gas-liquid separation can be performed between reactor units to allow for removal of light ends and contaminant gases.

A "hydroprocessing unit" refers to hydrotreating reactor, a hydrocracking reactor, or a hydrofinishing reactor. A hydroprocessing unit is used to alter one or more qualities of a feed stream. Examples of changes resulting from hydroprocessing can include, but are not limited to, reducing the heteroatom content of the feed, performing conversion on the feed to provide viscosity index uplift, and/or performing aromatic saturation on the feed.

With regard to heteroatom removal, the conditions in a hydroprocessing unit can be set to reduce the sulfur content of the hydroprocessed effluent to 250 wppm or less, or 200 wppm or less, or 150 wppm or less, or 100 wppm or less, or 50 wppm or less, or 25 wppm or less, or 10 wppm or less. In particular, the sulfur content of the hydroprocessed effluent is 1 wppm to 250 wppm, or 1 wppm to 50 wppm, or 1 wppm to 10 wppm.

When the hydroprocessing includes hydrotreating aspects, any suitable hydrotreating catalyst can be utilized, such as a catalyst comprising at least one Group 8-10 non-noble metal (for example selected from Ni, Co, and a combination thereof) and at least one Group 6 metal (for example selected from Mo, W, and a combination thereof). Such a catalyst can include a suitable support and/or filler material (e.g., comprising alumina, silica, titania, zirconia, or a combination thereof). Alternatively, the catalyst may be provided as bulk metal catalyst particles. By way of illustration, some examples of suitable hydrotreating catalysts are described in the following publications that are incorporated by reference herein: U.S. Pat. Nos. 6,156,695, 6,162,350, 6,299,760, 6,582,590, 6,712,955, 6,783,663, 6,863,803, 6,929,738, 7,229,548, 7,288,182, 7,410,924, 7,544,632, and 8,294,255, U.S. Patent Application Publication Nos. 2005/0277545, 2006/0060502, 2007/0084754, and 2008/0132407, and International Publication Nos. WO 04/007646, WO 2007/084437, WO 2007/084438, WO 2007/084439, and WO 2007/084471, inter alia. In some examples, hydrotreating is performed at temperatures of 200° C. to 450° C. or 315° C. to 425° C.; pressures of 250 psig (~1.8 MPag) to 5000 psig (~34.6 MPag) or 500 psig (~3.4 MPag) to 3000 psig (~20.8 MPag), or 800 psig (~5.5 MPag) to 2500 psig (~17.2 MPag); Liquid Hourly Space Velocities (LHSV) of 0.2-10 hr-1; and hydrogen treat rates of 200 scf/B (35.6 m3/m3) to 10,000 scf/B (1781 m3/m3), or 500 (89 m3/m3) to 10,000 scf/B (1781 m3/m3).

In some examples, the hydrotreating catalyst is a bulk metal catalyst, or a combination of stacked beds of supported and bulk metal catalyst. By bulk metal, it is meant that the catalysts are unsupported wherein the bulk catalyst particles comprise 30-100 wt. % of at least one Group 8-10 non-noble metal and at least one Group 6 metal, based on the total weight of the bulk catalyst particles, calculated as metal oxides and wherein the bulk catalyst particles have a surface area of at least 10 m2/g. It is furthermore preferred that the bulk metal hydrotreating catalysts used herein comprise 50 to 100 wt. %, and even more preferably 70 to 100 wt. %, of at least one Group 8-10 non-noble metal and at least one Group 6 metal, based on the total weight of the particles, calculated as metal oxides. The amount of Group 6 and Group 8-10 non-noble metals can be determined via TEM-EDX. Examples of suitable hydrotreating catalysts include, but are not limited to, Albemarle KF 848, KF 860, KF 868, KF 870, KF 880, KF 861, KF 905, KF 907, and Nebula; Criterion LH-21, LH-22, and DN-3552; Haldor-Topsoe TK-560 BRIM, TK-562 HyBRIM, TK-565 HyBRIM, TK-569 HyBRIM, TK-907, TK-911, and TK-951; Axens HR 504, HR 508, HR 526, and HR 544. Hydrotreating may be carried out with one catalyst or combinations of the previously listed catalysts.

In aspects that include hydrocracking under sour conditions, the hydrocracking catalyst can comprise any suitable or standard hydrocracking catalyst, for example, a zeolitic base selected from zeolite Beta, zeolite X, zeolite Y, faujasite, ultrastable Y (USY), dealuminized Y (Deal Y), Mordenite, ZSM-3, ZSM-4, ZSM-18, ZSM-20, ZSM-48, and combinations thereof, which zeolitic base can advantageously be loaded 20 with one or more active metals (e.g., either (i) a Group 8-10 noble metal such as platinum and/or palladium or (ii) a Group 8-10 non-noble metal such nickel, cobalt, iron, and combinations thereof, and a Group 6 metal such as molybdenum and/or tungsten). In this discussion, zeolitic materials are defined to include materials having a recognized zeolite framework structure, such as framework structures recognized by the International Zeolite Association. Such zeolitic materials can correspond to silicoaluminates, silicoaluminophosphates, aluminophosphates, and/or other combinations of atoms that are used to form a zeolitic framework structure. In addition to zeolitic materials, other types of crystalline acidic support materials may also be suitable. Optionally, a zeolitic material and/or other crystalline acidic material may be mixed or bound with other metal oxides such as alumina, titania, and/or silica. Details on suitable hydrocracking catalysts can be found in Bai et al. (US 2008/0146438).

A hydrocracking process under sour conditions is carried out at temperatures of 200° C. to 450° C., hydrogen partial pressures of from 250 psig to 5000 psig (~1.8 MPag to ~34.6 MPag), liquid hourly space velocities of from 0.2 hr-1 to 10 hr-1, and hydrogen treat gas rates of from 35.6 m3/m3 to 1781 m3/m3 (~200 SCF/B to ~10,000 SCF/B), Typically, in most cases, the conditions include temperatures in the range of 300° C. to 450° C., hydrogen partial pressures of from 500 psig to 2000 psig (~3.5 MPag to ~13.9 MPag), liquid hourly space velocities of from 0.3 hr-1 to 5 hr-1 and hydrogen treat gas rates of from 213 m3/m3 to 1068 m3/m3 (~1200 SCF/B to ~6000 SCF/B).

A conversion process under sweet conditions is performed under conditions similar to those used for a sour hydrocracking process, or the conditions can be different. Generally, the conditions in a sweet conversion stage are less severe than a hydrocracking process in a sour stage. Suitable conversion conditions for a non-sour stage include, but are not limited to, conditions similar to a sour stage. Suitable conversion conditions include temperatures of about 550° F. (288° C.) to about 840° F. (449° C.), hydrogen partial pressures of from about 1000 psia to about 5000 psia (~6.9 MPa-a to 34.6 MPa-a), liquid hourly space velocities of from 0.05 hr-1 to 10 hr-1, and hydrogen treat gas rates of from 35.6 m3/m3 to 1781 m3/m3 (200 SCF/B to 10,000 SCF/B). In other embodiments, the conditions include temperatures in the range of about 600° F. (343° C.) to about 815° F. (435° C.), hydrogen partial pressures of from about 1000 psia to about 3000 psia (~6.9 MPa-a to 20.9 MPa-a), and hydrogen treat gas rates of from about 213 m3/m3 to about 1068 m3/m3 (1200 SCF/B to 6000 SCF/B). The LHSV can be from about 0.25 hr-1 to about 50 hr-1, or from about 0.5 hr-1 to about 20 hr-1, and preferably from about 1.0 hr-1 to about 4.0 hr-1.

In various embodiments, catalytic dewaxing is included in the above described process configurations. Preferably, the dewaxing catalysts are zeolites (and/or zeolitic crystals) that perform dewaxing primarily by isomerizing a hydrocarbon feedstock. More preferably, the catalysts are zeolites with a unidimensional pore structure. Suitable catalysts include 10-member ring pore zeolites, such as EU-1, ZSM-35 (or ferrierite), ZSM-11, ZSM-57, NU-87, SAPO-11, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from 20:1 to 40:1 can sometimes be referred to as SSZ-32. Other zeolitic crystals that are isostructural with the above materials include Theta-1, NU-10, EU-13, KZ-1, and NU-23.

In various embodiments, the dewaxing catalysts further include a metal hydrogenation component. The metal hydrogenation component is typically a Group 6 and/or a Group 8-10 metal. Preferably, the metal hydrogenation component is a Group 8-10 noble metal. Preferably, the metal hydrogenation component is Pt, Pd, or a mixture thereof. A dewaxing catalyst can be a catalyst with a low ratio of silica to alumina. For example, for ZSM-48, the ratio of silica to alumina in the zeolite is less than 200:1, or less than 110:1, or less than 100:1, or less than 90:1, or less than 80:1. In particular examples, the ratio of silica to alumina is from 30:1 to 200:1, or 60:1 to 110:1, or 70:1 to 100:1. A dewaxing catalyst can also include a binder. A zeolite (or other zeolitic material) can be combined with binder in any convenient manner. For example, a bound catalyst is produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. Optionally, a binder composed of two or more metal oxides is used.

Process conditions in a catalytic dewaxing operation include a temperature of from 200 to 450° C., preferably 270 to 400° C., a hydrogen partial pressure of from 1.8 to 34.6 MPag (~250 to ~5000 psi), preferably 4.8 to 20.8 MPag, a liquid hourly 5 space velocity of from 0.2 to 10 hr-1, preferably 0.5 to 3.0 hr-1, and a hydrogen circulation rate of from 35.6 to 1781 m3/m3 (~200 to ~10,000 SCF/B), preferably 178 to 890.6 m3/m3 (~1000 to ~5000 scfB). Additionally or alternately, the conditions include temperatures in the range of 600° F. (~343° C.) to 815° F. (~435° C.), hydrogen partial pressures of from 500 psig to 3000 psig (~3.5 MPag to ~20.9 MPag), and hydrogen treat gas rates of from 213 m3/m3 to 1068 m3/m3 (~1200 SCF/B to ~6000 SCF/B).

In various embodiments, a hydrofinishing and/or aromatic saturation process is also provided. The hydrofinishing and/or aromatic saturation can occur prior to dewaxing and/or after dewaxing. The hydrofinishing and/or aromatic saturation can occur either before or after fractionation. If hydrofinishing and/or aromatic saturation occurs after fractionation, the hydrofinishing is performed on one or more portions of the fractionated product, such as performed on one or more lubricant base stock portions. Alternatively, the entire effluent from the last conversion or dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically, a hydrofinishing and/or aromatic saturation process will be performed in a separate reactor from dewaxing or hydrocracking processes for practical reasons, such as facilitating use of a lower temperature for the hydrofinishing or aromatic saturation process.

Hydrofinishing and/or aromatic saturation catalysts include catalysts containing Group 6 metals, Group 8-10 metals, and mixtures thereof. In an embodiment, preferred metals include at least one metal sulfide having a strong hydrogenation function. In another embodiment, the hydrofinishing catalyst include a Group 8-10 noble metal, such as Pt, Pd, or a combination thereof. The mixture of metals may also be present as bulk metal catalysts wherein the amount of metal is 30 wt. % or greater based on catalyst weight. Suitable metal oxide supports include low acidic oxides such as silica, alumina, silica-aluminas or titania, preferably alumina. The preferred hydrofinishing catalysts for aromatic saturation comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as 20 weight percent for non-noble metals. In an embodiment, a preferred hydrofinishing catalyst includes a crystalline material belonging to the M41S class or family of catalysts. The M41S family of catalysts are mesoporous materials having high silica content. Examples include MCM-41, MCM-48 and MCM-50. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction. Hydrofinishing conditions include temperatures from 125° C. to 425° C., preferably 180° C. to 280° C., total pressures from 500 psig (~3.4 MPag) to 3000 psig (~20.7 MPag), preferably 1500 psig (~10.3 MPag) to 2500 psig (~17.2 MPag), and liquid hourly space velocity (LHSV) from 0.1 hr-1 to 5 hr-1, preferably 0.5 hr-1 to 1.5 hr-1.

A fractioning unit includes a feed inlet and two or more fractionate outlets. In general, a fractionating unit separates a feed stream comprising multiple components into two or more fractions according to differences in component characteristics, such as volatility or the like. The fractioning may be performed at elevated temperatures and/or under vacuum conditions.

A separator can be used in-line between reactors and/or process units to remove gas phase sulfur and nitrogen contaminants. One option for the separator is to simply perform a gas-liquid separation to remove contaminants. Another option is to use a separator such as a flash separator that performs a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent is also removed, thus reducing the volume of effluent that is processed in the second or other subsequent stages. Of course, any low boiling contaminants in the effluent would also be separated into the portion boiling below the temperature cut point.

When a lubricant base stock product is produced, this lubricant base stock product can be further fractionated to form a plurality of products. For example, lubricant base stock products are made corresponding to various viscosity cuts such as a 2 cSt cut, a 4 cSt cut, a 6 cSt cut, and/or a cut having a viscosity higher than 6 cSt. For example, a lubricant base oil product fraction having a viscosity of at least 2 cSt is a fraction suitable for use in low pour point application such as transformer oils, low temperature hydraulic oils, low viscosity engine oils, or automatic transmission fluid. A lubricant base oil product fraction having a viscosity of at least 4 cSt is a fraction having a controlled volatility and low pour point, such that the fraction is suitable for engine oils made according to SAE J300 in 0W- or 5W- or 10W-grades. This fractionation can be performed at the time a fuel product fraction is separated from the lubricant base stock product, or the base stock fractionation can occur at a later time.

Preparing Lubricating Oils from Base Stocks

Finished lubricants (e.g., engine oils, crankcase oils, industrial lubricants) are typically prepared by blending one or more base stocks with various additives. The additives are used to improve or alter certain properties of the finished lubricant so as to meet desired performance standards. For example, additives may be used to improve oxidation stability, increase viscosity, raise the viscosity index, and control formation of deposits. However, in general, additives are expensive and, furthermore, achievable additive loadings within a finished lubricant are limited due to miscibility problems and the like. For these reasons, it is generally desirable to utilize a base stock (or a blend of base stocks) that is as close to the desired performance targets of the finished lubricant as practical so that only a small amount additive is required. However, higher grade base stocks are also generally more expensive than lower grade base stocks due to greater manufacturing difficulties associated with producing the higher grade base stocks and generally lower yields of high performance base stocks from any given crude feed. The disclosed processes for production of Group III/III+ base stock utilizing advantageous crudes are desirable for, amongst various reasons, the ability to provide higher yield and/or lower cost production of Group III/III+ base stock for production of high grade finished lubricants.

A base stock or a base oil constitutes the major component of finished lubricant composition and typically is present in an amount from about 50 to about 99 wt. %, preferably from about 70 to about 95 wt. %, and more preferably from about 85 to about 95 wt. %, based on the total weight of the finished lubricant composition. As described herein, additives constitute a minor component of the finished lubricant composition and typically are present in an amount ranging from about less than 50 wt. %, preferably less than about 30 wt. %, and more preferably less than about 15 wt. %, based on the total weight of the finished lubricant composition.

In general, many additives are commercially available materials. These additives may be added separately but are usually provided in pre-combined packages be obtained from suppliers of lubricant oil additives. Additive packages with a variety of ingredients, proportions and characteristics are available and selection of the appropriate package will take the intended use of the ultimate composition into account.

The low temperature and oxidation performance of lubricating oil base stocks in formulated lubricants are determined from MRV (mini-rotary viscometer) for low temperature performance measured by ASTM D4684, or for oxidation performance measured by oxidation stability time measured by pressure differential scanning calorimetry (CEC-L-85, which is the equivalent of ASTM D6186).

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

Example—Specific Identification of Advantageous Crudes

Three different crudes (Crude A, Crude B, and Crude C) from three different geographic formations were characterized and evaluated. The Crude API and certain physical properties of the VGO fraction determined for these different crudes are provided in Table 3.

TABLE 3

| | Crude | | |
|---|---|---|---|
| | A | B | C |
| Crude API | 49 | 43 | 31 |
| Compositional Ratio | 3.0 | 1.8 | 1.1 |
| Sulfur (wt. %) | 0.12 | 0.28 | 1.33 |
| Nitrogen (wppm) | 120 | 570 | 530 |
| Solvent Dewaxed Oil VI | 110 | 71 | 61 |
| Dry Wax (wt. %) | 29 | 14 | 10 |

Figure 4:
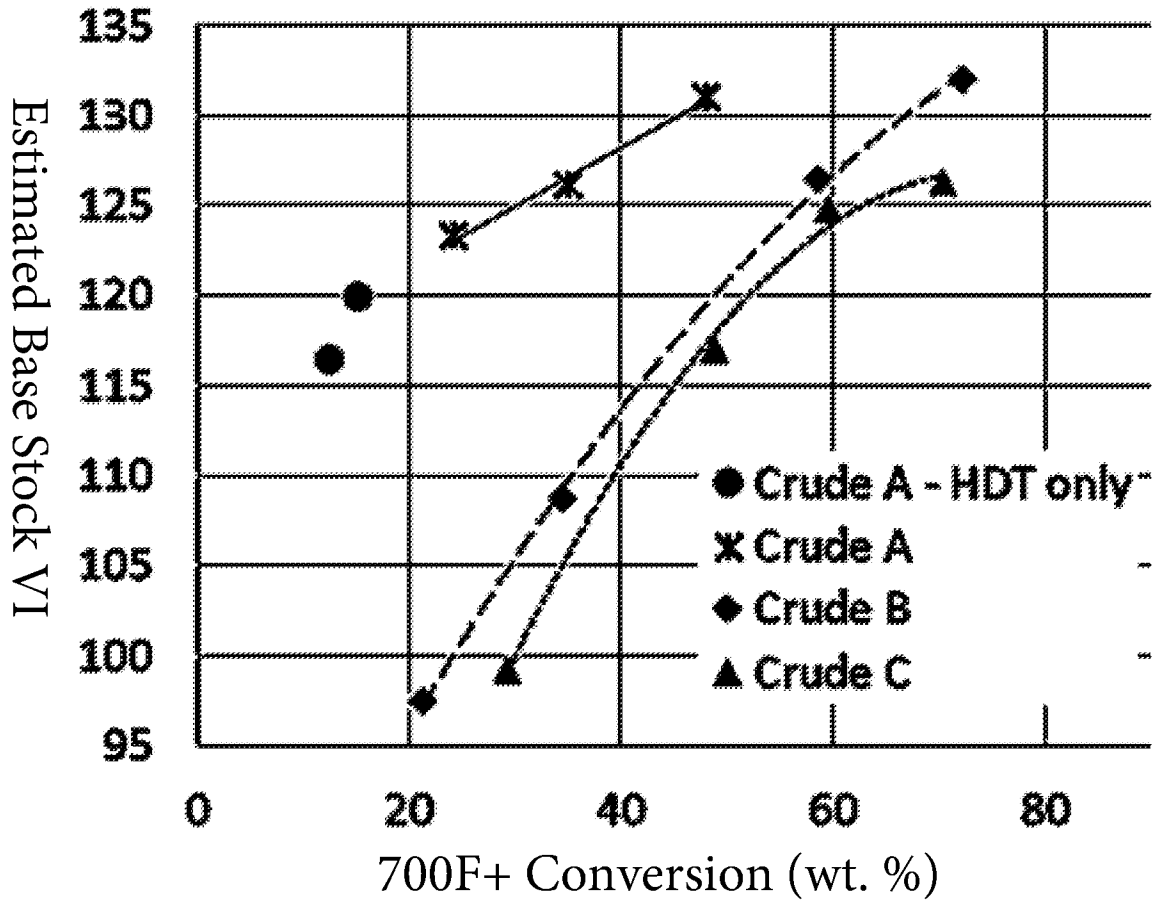
FIG. 4 depicts normalized base stock viscosity index (VI) vs. overall conversion (+700° F.) of various crude types from different geographic sources.

A fraction from each crude type was hydroprocessed over a 75:25 vol. % mix of hydrotreating (Albemarle KF-868) and hydrocracking (UOP HC-410LT) catalysts, respectively, at 1800 psig and 5000 scf/bbl hydrogen. FIG. 4 shows the estimated viscosity index relative to the 700 F+ conversion (wt. %). The "Estimated Base Stock VI" axis corresponds to an estimated 1 to viscosity index assuming sufficient catalytic dewaxing is performed to achieve a target pour point of −18° C. in the resultant base stock. For the dry wax amount, the amount of dry wax was corrected to the expected value at a pour point of −18° C. using a correction factor of ~0.33 wt. %/° C. of pour point. For the viscosity index, the viscosity index was corrected to the expected value at a pour point of −18° C. based on a correction of 0.33 VI/° C. of pour point. The designation "HDT-only" for certain data points indicates only hydrotreating catalyst was used. For all other data points, hydrotreating and hydrocracking catalyst was used as described.

FIG. 4 depicts estimated base stock viscosity index (VI) vs. overall conversion (+700° F.) for various crude types (Crude A, Crude B, and Crude C) from three different geographic sources. As shown in FIG. 4, only certain crudes are capable of achieving Group III+ level viscosity indexes (i.e., VI≥130). In particular, some grades of Crude A are capable of achieving Group III+ viscosity indexes, whereas the other depicted crudes are not capable of achieving Group III+ viscosity indexes. The API gravity of the Crude A in FIG. 4 is estimated as approximately 49. Additionally, a lower 700 F+ conversion (wt. %) (i.e., lower severity hydroprocessing) was required for Crude A to achieve Group III and Group III+ level viscosity indexes. This indicates Crude A is highly suited for the disclosed simplified production process(es).

Figure 5:
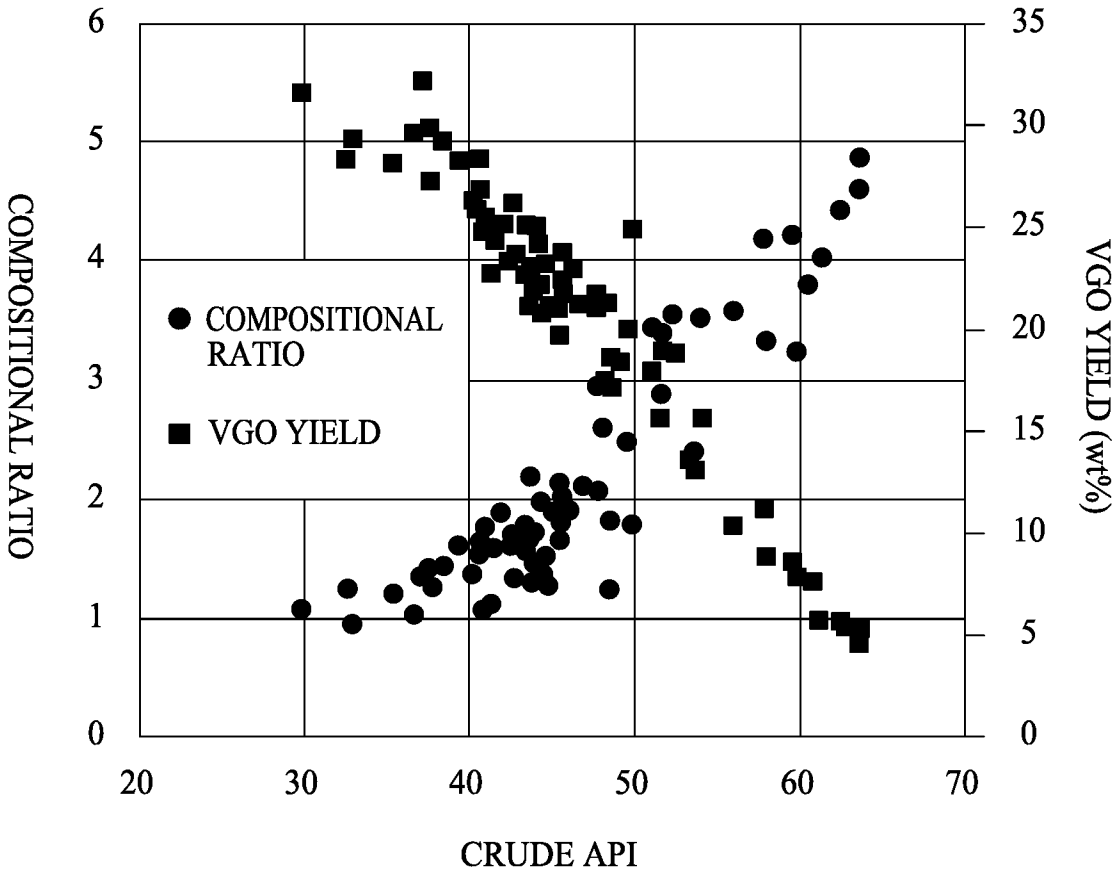
FIG. 5 is a graph illustrating the relationship between vacuum gas oil yield vs. API gravity and the vacuum gas oil compositional ratio vs. API gravity for a particular crude oil type.

FIG. 5 is a graph illustrating the relationship between vacuum gas oil yield vs. API gravity and a vacuum gas oil compositional ratio ((paraffin content+1-ring-species content) to (multi-ring-species content)) vs. API gravity for a set of samples of crude oil. As shown in the graph, for these crude oil samples, at higher API gravity values, the compositional ratios are higher. However, as the graph also shows, at higher API gravity values, the VGO yields are lower. Thus, the graph shows that the high compositional ratios are beneficial up to a certain API gravity but beyond a certain point will not be sufficient to yield a practical volume of Group II/III+ base stocks. Accordingly, the graph indicates that a desirable grade for the crudes represented in FIG. 5 is about 45 to 55, with the range of 49 to 53 being particularly desirable.

PCT and EP Clauses

1. A method of producing a base stock, comprising:
hydroprocessing a crude oil comprising a VGO fraction having a ratio of (a sum of paraffin content in wt. %+1-ring species content in wt. %) to (multi-ring species content in wt. %) greater than or equal to 1.5 to produce a base stock having a viscosity index greater than 120, as determined according to ASTM D2270-10.

2. The method of clause 1, wherein the crude oil has a paraffin content in a range of 25 to 76 wt. %, a naphthenes content in a range of 21 to 52 wt. %, and an aromatics content of 3 to 38 wt. %.

3. The method of clause 1 or 2, wherein the crude oil has a paraffin content in a range of 34-53 wt. %, a naphthenes contend in a range of 33-51 wt. %, and an aromatics content of 8-20 wt. %.

4. The method of any of clauses 1-3, wherein the crude oil has an API gravity less than 55, as measured according to ASTM D4052-16.

5. The method of any of clauses 1-4, wherein the crude oil has an API gravity in a range of 45 to 55, as measured according to ASTM D4052-16.

6. The method of any of clauses 1-5, wherein the crude oil has an API gravity in a range of 49 to 53, as measured according to ASTM D4052-16.

7. The method of any of clauses 1-6, wherein the viscosity index of the base stock is greater than 130.

8. The method of any of clauses 1-7, wherein the base stock has a saturates percentage greater than 90%.

9. The method of any of clauses 1-8, wherein the hydroprocessing provides a 700 F+ conversion (wt. %) in the range of 5% to 90%.

10. The method of any of clauses 1-9, wherein the hydroprocessing provides a 700 F+ conversion (wt. %) in the range of 10% to 70%.

11. The method of any of clauses 1-10, wherein the hydroprocessing provides a 700 F+ conversion (wt. %) in the range of 15% to 60%.

12. The method of any of clauses 1-11, wherein hydroprocessing uses a ratio of hydrotreating catalyst to hydrocracking catalyst that is greater than 1 to 1.

13. The method of any of clauses 1-12, wherein hydroprocessing uses a ratio of hydrotreating catalyst to hydrocracking catalyst that is greater than 2 to 1.

14. The method of any of clauses 1-13, wherein hydroprocessing uses a ratio of hydrotreating catalyst to hydrocracking catalyst that is greater than 3 to 1.

15. A method of producing a base stock, comprising:
hydroprocessing a crude oil comprising a VGO fraction having a ratio of (a sum of paraffin content in wt. %+1-ring species content in wt. %) to (multi-ring species content in wt. %) greater than or equal to 1.5 to produce a hydroprocessed effluent;
fractionating the hydroprocessed effluent to produce an upper fractionate, a lower fractionate, and a middle fractionate;
dewaxing the middle fractionate to produce a dewaxed effluent;
hydrofinishing the dewaxed effluent to produce a hydrofinished effluent; and fractionating the hydrofinished effluent to produce an overhead fractionate and a residual fractionate, wherein the residual fractionate is a base stock having a viscosity index greater than 120 as determined according to ASTM D2270-10.

16. The method of clause 15, wherein the crude oil has an API gravity that is within a range of 45 to 55, inclusive, as measured according to ASTM D4052-16.

17. The method of clause 15 or 16, wherein the crude oil has an API gravity greater than or equal to 49, as measured according to ASTM D4052-16.

18. The method of any of clauses 15-17, wherein the crude oil is a topped crude oil.

19. The method of any of clauses 15-18, wherein the viscosity index (VI) of the base stock is greater than 130, as determined according to ASTM D2270-10.

20. The method of any of clauses 15-19, wherein the base stock has a sulfur weight percent of less than or equal to 0.05, and a saturates level greater than or equal to 90 percent.

21. The method of clauses 15-20, wherein the crude oil has a paraffin content in a range of 25 to 76 wt. %, a naphthenes content in a range of 21 to 52 wt. %, and an aromatics content of 3 to 38 wt. %.

22. The method of any of clauses 15-21, wherein the crude oil has a paraffin content in a range of 34-53 wt. %, a naphthenes contend in a range of 33-51 wt. %, and an aromatics content of 8-20 wt. %.

23. The method of any of clauses 15-22, wherein the hydroprocessing is a hydrotreatment performed in a hydrotreating unit, and the crude oil is fed directly to the hydrotreating unit.

24. The method of any of clauses 15-22, wherein the hydroprocessing is a hydrocracking performed in a hydrocracking unit, and the crude oil is fed directly to the hydrocracking unit.

25. The method of any of clauses 15-24, wherein the dewaxing is performed using a noble-metal containing zeolite catalyst.

26. The method of any of clauses 15-25, wherein the hydrofinishing is performed to using a noble-metal containing catalyst.

27. The method of any of clauses 15-23, 25, and 26, wherein the crude oil has an API gravity that is within a range of 45 to 55, inclusive, as measured according to ASTM D4052-16, the hydroprocessing is performed in a hydroprocessing unit, and the crude oil is fed directly to the hydroprocessing unit.

28. The method of any of clauses 15-23 and 25-27, wherein the viscosity index (VI) of the base stock oil is greater than 130, as determined according to ASTM D2270-10.

29. A method of producing a base stock, comprising:
feeding a crude oil comprising a VGO fraction having a ratio of (a sum paraffin content in wt. %+1-ring species content in wt. %) to (multi-ring species content in wt. %) greater than or equal to 1.5 to a hydroprocessing unit to produce a hydroprocessed effluent;
fractionating the hydroprocessed effluent in a first fractionating unit to produce an upper fractionate and a lower fractionate;
feeding the lower fractionate to a dewaxing unit to produce a dewaxed effluent;
feeding the dewaxed effluent to a hydrofinishing unit to produce a hydrofinished effluent; and fractionating the hydrofinished effluent in a second fractionating unit to produce an overhead fractionate and a residual fractionate, wherein
the residual fractionate is a base stock oil having a viscosity index (VI) greater than 120, as determined according to ASTM D2270-10.

30. The method of clause 29, wherein the crude oil has an API gravity that is within a range of 45 to 55, inclusive, as measured according to ASTM D4052-16.

31. The method of clause 29 or 30, wherein the base stock has a sulfur weight percent of less than or equal to 0.05, the base stock has a saturates level greater than or equal to 90 percent, and the viscosity index (VI) of the base stock is greater than 130, as determined according to ASTM D2270-10.

32. The method of any of clauses 29-31, wherein the hydroprocessing is a hydrotreatment process.

33. The method of any of clauses 29-31, wherein the hydroprocessing is a hydrocracking process.

34. A method of producing a base stock, comprising:
fractionating a crude oil comprising a VGO fraction having a ratio of (a sum of paraffin content in wt. %+1-ring species content in wt. %) to (multi-ring species content in wt. %) greater than or equal to 1.5 to produce a vacuum gas oil (VGO);
hydroprocessing the VGO to produce a hydroprocessed effluent;
fractionating the hydroprocessed effluent to produce an upper fractionate, a lower fractionate, and a middle fractionate;
dewaxing the middle fractionate to produce a dewaxed effluent;
hydrofinishing the dewaxed effluent to produce a hydrofinished effluent; and
fractionating the hydrofinished effluent to produce an overhead fractionate and a residual fractionate, wherein
the residual fractionate is a base stock having a viscosity index greater than 120 as determined according to ASTM D2270-10.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method of producing a base stock, comprising:
hydroprocessing a crude oil, said crude oil having an API gravity in a range of 49 to 53, as measured according to ASTM D4052-16 comprising a vacuum gas oil (VGO) fraction having a ratio of (a sum of paraffin content in wt. %+1-ring species content in wt. %) to (multi-ring species content in wt. %) greater than or equal to 1.5 to produce a base stock having a viscosity index greater than 120, as determined according to ASTM D2270-10.

2. The method of claim 1, wherein the crude oil has a paraffin content in a range of 25 to 76 wt. %, a naphthenes content in a range of 21 to 52 wt. %, and an aromatics content of 3 to 38 wt. %.

3. The method of claim 1, wherein the crude oil has a paraffin content in a range of 34-53 wt. %, a naphthenes contend in a range of 33-51 wt. %, and an aromatics content of 8-20 wt. %.

4. The method of claim 1, wherein the viscosity index of the base stock is greater than 130.

5. The method of claim 4, wherein the base stock has a saturates percentage greater than 90 wt. %.

6. The method of claim 1, wherein the hydroprocessing provides a 700F+conversion (wt. %) in the range of 5% to 90%.

7. The method of claim 1, wherein the hydroprocessing provides a 700F+conversion (wt. %) in the range of 10% to 70%.

8. The method of claim 1, wherein the hydroprocessing provides a 700F+conversion (wt. %) in the range of 15% to 60%.

9. The method of claim 1, wherein hydroprocessing uses a ratio of hydrotreating catalyst to hydrocracking catalyst that is greater than 1 to 1.

10. The method of claim 1, wherein hydroprocessing uses a ratio of hydrotreating catalyst to hydrocracking catalyst that is greater than 2 to 1.

11. The method of claim 1, wherein hydro processing uses a ratio of hydrotreating catalyst to hydrocracking catalyst that is greater than 3 to 1.

12. A method of producing a base stock, comprising:
hydroprocessing a crude oil comprising a vacuum gas oil (VGO) fraction having a ratio of (a sum of paraffin content in wt. %+1-ring species content in wt. %) to (multi-ring species content in wt. %) greater than or equal to 1.5 to produce a hydroprocessed effluent;
fractionating the hydroprocessed effluent to produce an upper fractionate, a lower fractionate, and a middle fractionate;
dewaxing the middle fractionate to produce a dewaxed effluent;
hydrofinishing the dewaxed effluent to produce a hydrofinished effluent; and
fractionating the hydrofinished effluent to produce an overhead fractionate and a residual fractionate, wherein
the residual fractionate is a base stock having a viscosity index greater than 120 as determined according to ASTM D2270-10.

13. The method of claim 12, wherein the crude oil has an API gravity of 45 to 55, as measured according to ASTM D4052-16.

14. The method claim 12, wherein the crude oil has an API gravity of 49 to 53, as measured according to ASTM D4052-16.

15. The method of claim 12, wherein the crude oil is a topped crude oil.

16. The method of claim 12, wherein the viscosity index (VI) of the base stock is greater than 130, as determined according to ASTM D2270-10.

17. The method of claim 12, wherein the base stock has a sulfur weight percent of less than or equal to 0.05, and a saturates level greater than or equal to 90 wt. percent.

18. The method of claim 12, wherein the crude oil has a paraffin content in a range of 25 to 76 wt. %, a naphthenes content in a range of 21 to 52 wt. %, and an aromatics content of 3 to 38 wt. %.

19. The method of claim 12, wherein the crude oil has a paraffin content in a range of 34-53 wt. %, a naphthenes contend in a range of 33-51 wt. %, and an aromatics content of 8-20 wt. %.

20. The method of claim 12, wherein the hydroprocessing is a hydrotreatment performed in a hydrotreating unit, and the crude oil is fed directly to the hydrotreating unit.

21. The method of claim 12, wherein the hydroprocessing is a hydrocracking performed in a hydrocracking unit, and the crude oil is fed directly to the hydrocracking unit.

22. The method of claim 12, wherein the dewaxing is performed using a noble-metal containing zeolite catalyst.

23. The method of claim 12, wherein the hydrofinishing is performed using a noble-metal containing catalyst.

24. The method of claim 12, wherein the crude oil has an API gravity that is within a range of 45 to 55, inclusive, as measured according to ASTM D4052-16, the hydroprocessing is performed in a hydroprocessing unit, and the crude oil is fed directly to the hydroprocessing unit.

25. The method of claim 24, wherein the viscosity index (VI) of the base stock oil is greater than 130, as determined according to ASTM D2270-10.

26. A method of producing a base stock, comprising:

feeding a crude oil comprising a VGO fraction having a ratio of (a sum paraffin content in wt. %+1-ring species content in wt. %) to (multi-ring species content in wt. %) greater than or equal to 1.5 to a hydroprocessing unit to produce a hydroprocessed effluent;

fractionating the hydroprocessed effluent in a first fractionating unit to produce an upper fractionate and a lower fractionate;

feeding the lower fractionate to a dewaxing unit to produce a dewaxed effluent;

feeding the dewaxed effluent to a hydrofinishing unit to produce a hydrofinished effluent; and fractionating the hydrofinished effluent in a second fractionating unit to produce an overhead fractionate and a residual fractionate, wherein the residual fractionate is a base stock oil having a viscosity index (VI) greater than 120, as determined according to ASTM D2270-10.

27. The method of claim 26, wherein the crude oil has an API gravity that is within a range of 45 to 55, inclusive, as measured according to ASTM D4052-16.

28. The method of claim 26, wherein the base stock has a sulfur weight percent of less than or equal to 0.05, the base stock has a saturates level greater than or equal to 90 wt. percent, and the viscosity index (VI) of the base stock is greater than 130, as determined according to ASTM D2270-10.

29. The method of claim 26, wherein the hydroprocessing is a hydrotreatment process.

30. The method of claim 26, wherein the hydroprocessing is a hydrocracking process.

31. A method of producing a base stock, comprising:

fractionating a crude oil comprising a vacuum gas oil (VGO) fraction having a ratio of (a sum of paraffin content in wt. %+1-ring species content in wt. %) to (multi-ring species content in wt. %) greater than or equal to 1.5 to produce a vacuum gas oil (VGO);

hydroprocessing the VGO to produce a hydroprocessed effluent;

fractionating the hydroprocessed effluent to produce an upper fractionate, a lower fractionate, and a middle fractionate;

dewaxing the middle fractionate to produce a dewaxed effluent;

hydrofinishing the dewaxed effluent to produce a hydrofinished effluent; and fractionating the hydrofinished effluent to produce an overhead fractionate and a residual fractionate, wherein the residual fractionate is a base stock having a viscosity index greater than 120 as determined according to ASTM D2270-10.

* * * * *